United States Patent [19]

Dunn

[11] 4,071,169

[45] Jan. 31, 1978

[54] ELECTROSTATIC METERING DEVICE

[76] Inventor: John P. Dunn, 956 Graylea Circle, Elmira, N.Y. 14905

[21] Appl. No.: 703,982

[22] Filed: July 9, 1976

[51] Int. Cl.[2] ..... B67D 5/06

[52] U.S. Cl. ..... 222/76

[58] Field of Search ..... 222/76, DIG. 1, 196; 239/3, 15; 361/285

[56] References Cited

U.S. PATENT DOCUMENTS

| | | | |
|---|---|---|---|
| 3,221,938 | 12/1965 | Yonkers et al. | 222/76 |
| 3,680,779 | 8/1972 | Reilly | 239/15 |

*Primary Examiner*—Allen N. Knowles

*Attorney, Agent, or Firm*—Sughrue, Rothwell, Mion, Zinn and Macpeak

[57] ABSTRACT

An electro-static device for mixing and blending accurately metered streams of finely divided particulate matter is disclosed. The device comprises an electro-static conveyor and at least two electro-static metering devices. The electro-static metering device can be used separately from the electro-static conveyor - for instance, with an electro-static sieve. Additionally, two improvements applicable both to electro-static conveyors and to electro-static sieves are disclosed.

6 Claims, 12 Drawing Figures

ELECTROSTATIC METERING DEVICE

FIELD OF THE INVENTION

This invention relates to electro-static devices, including electro-static conveyors, electro-static feeders, and electro-static sieves, and to processes using those devices.

SUMMARY OF THE INVENTION

Broadly speaking, the invention comprises an electro-static device for mixing and blending accurately metered streams of finely divided particulate matter. The devices comprise an electro-static conveyor and at least two electro-static metering devices. The electro-static metering device can be used separately from the electro-static conveyor — for instance, with an electro-static sieve. Additionally, the invention comprises two improvements applicable both to electro-static conveyors and to electro-static sieves.

DETAILED DESCRIPTION OF THE PREFERRED EMBODIMENTS

Figure 2:
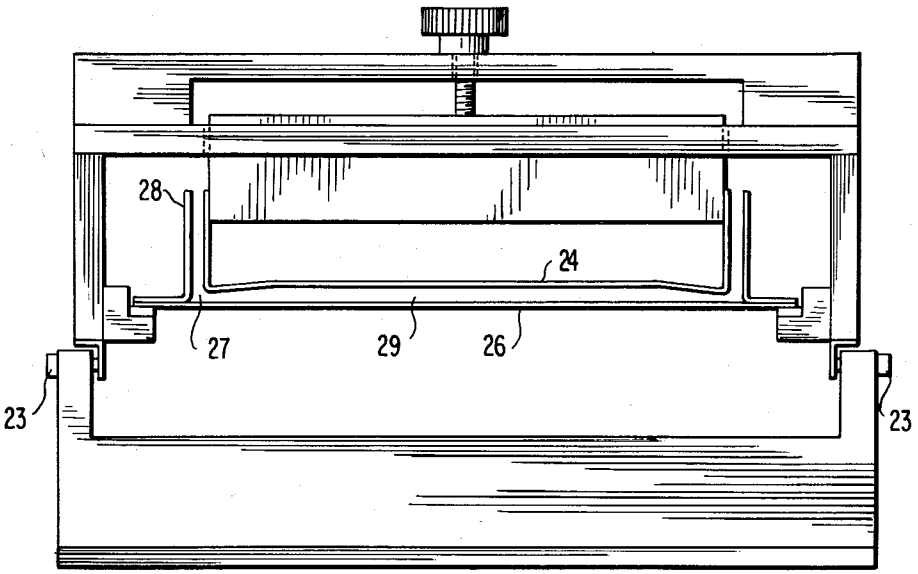
FIG. 2 is a view along the line 2—2 in FIG. 1.

FIGS. 1–6 show an electro-static conveyor 20 have a single electro-static metering device 22 as an input. As is well known in the art, such electro-static conveyors comprise an upper electrode 24 and a lower electrode 26 which are maintained during use of the conveyor at a difference in potential in the range of 2,000 volts to 10,000 volts. The exact difference in potential used in any given conveyor at any given time is a function of the size and electrical characteristics of the particulate matter being conveyed through the conveyor, as well as such practical constraints as arcing caused by the electrical breakdown of air. As an example, I have successfully used a difference in potential of 4,000 volts to convey molybdenum particles ranging in size between 75 micrometers and 20 micrometers through the apparatus shown in FIGS. 1–6.

In electro-static conveyors such as shown in FIGS. 1–6, the particles being conveyed oscillate rapidly back and forth between the electrodes, and their forward motion is due to one or more of several factors, such as movement of the air between the electrodes, electric field attraction, magnetic attraction, inter-particulate repulsion, or, in the usual case, the force of gravity. The conveyor shown in FIGS. 1–6 employs the force of gravity to move the particles, and, to that end, the conveyor 20 is pivotable about the stub axles 23 and lockable in a tilted position by the hold-down screws 25.

Figure 7:
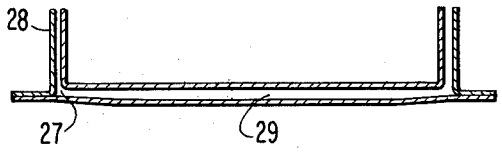
FIG. 7 shows a first alternative to a portion of the embodiment shown in FIG. 2.
Figure 8:
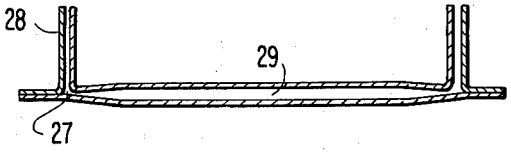
FIG. 8 shows a second alternative to a portion of the embodiment shown in FIG. 2.
Figure 12:
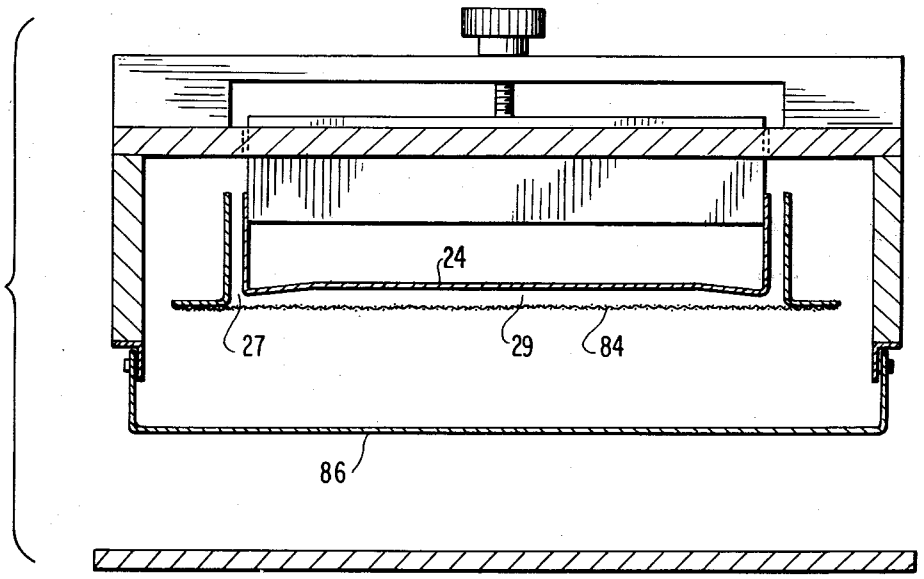
FIG. 12 is a view along the line 12—12 in FIG. 11.

A long-standing problem with electro-static conveyors has been loss of particulate matter out through the lateral edges of the electrodes, which of course can not touch each other. The overall forward motion of the particulate matter is imposed as described in the preceding paragraph, but lateral motion of the particulate matter is random. Upturned edges of the electrodes, as shown in FIGS. 2, 7, and 8 at 28 have been used to laterally confine the particulate matter, but do not entirely solve the problem unless they are fairly high, making the conveyors undesirably bulky. Also, the processing zone 27 shown in FIGS. 2, 7, 8, and 12 is undesirable because the particulates do not oscillate along the same axis as in the processing zone 29, causing a variation in the end result. To overcome the edge control problem in a simpler, cheaper, and less volume-consuming fashion, I have designed the lateral edges of my electrodes to converge. This may be accomplished by bending the upper electrode towards the lower electrode, as shown in FIG. 2, by bending the lower electrode toward the upper electrode, as shown in FIG. 7, or by bending both electrodes towards the other electrode, as shown in FIG. 8. Additionally, the converging portion can be curved rather than straight. In any case, because the particles tend to follow the field lines rather than moving in straight lines, the converging electrodes give the particles a component of motion back towards the center of the electrodes every time the particles strike a bent portion of the electrode. Of course, the sharper the converging angle and the closer the two electrodes come, the more effective the confinement will be, but apparatus of the appropriate proportions shown in FIGS. 2, 7, and 8 has been found to give very good control over edge loss. Also, the converging electrodes can obviously be combined with upturned edges, as shown in those drawings, and converging electrodes can be used with an electro-static sieve as shown in FIG. 12 as well as with an electro-static conveyor.

Similar converging devices have been patented with the major emphasis on the converging electrode. In my devices the angle is not the critical dimension, but the length of the hypotenuse is critical. When processing fine particles, the particle quantity per square inch becomes extremely high creating laterally repelling forces that can force particulates out of the major processing area if the hypotenuse (or the curved analog of a straight line hypotenuse) is too short. Experience with my process has shown for the majority of particulates (20–180 micrometers), the hypotenuse should be greater than 1.5 inches long.

Another reason for this requirement is that the spacing between the upper and lower electrodes is usually between $\frac{1}{8}$ to $\frac{1}{2}$ inch with the spacing at the end of the constriction 1/16 to 3/16 inch. This small spacing does not permit large confining angles to be used.

Another long-standing problem with both electro-static conveyors and electro-static sieves has been obtaining a steady, accurately metered flow of the particulate matter, particularly at very low flow rates and particularly with very finely divided matter. Conventional gravity-operated and/or vibration assisted hopper feeders are subject to uncontrollable pulsing in such conditions. To overcome this problem, I have devised on electro-static metering device which may be most easily understood with reference to FIG. 5. As shown therein, it comprises two spaced electrodes, an upper electrode 30 and a lower electrode 32, the upper electrode 30 being vertically positioned above the lower electrode 32 but offset therefrom so that the lower electrode 32 extends beyond the upper electrode 30 on one side of the metering device by a short distance and the upper electrode 30 extends beyond the lower electrode on the opposite side of the metering device by a short distance. The metering device further comprises means 34 for placing finely divided particulate matter on the portion of the lower electrode 32 which extends beyond the upper electrode 30 and output means 36 positioned beneath the portion of the upper electrode 30 which extends beyond the lower electrode 32.

Figure 5:
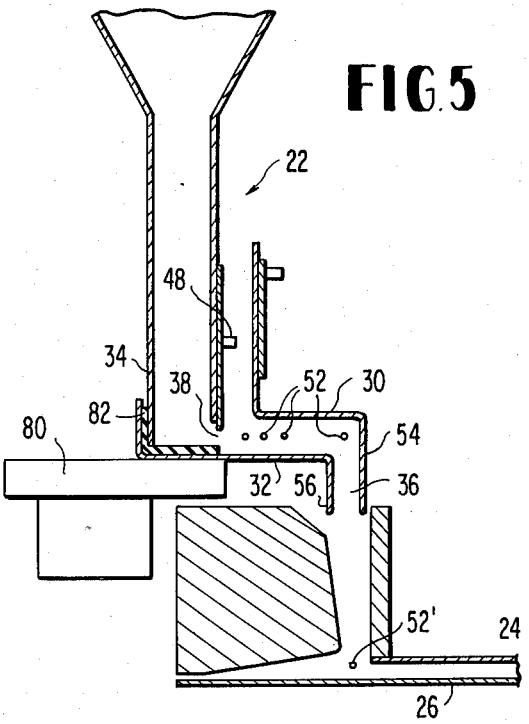
FIG. 5 is a view along the line 5—5 in FIG. 3.

The means 34 for placing finely divided particulate matter on the portion of the lower electrode 32 which extends beyond the upper electrode preferably comprise, as shown in FIG. 5, a chute ending in an aperture 38 positioned with respect to the lower electrode 32 such that finely divided particulate matter in the chute will spill out onto the portion of the lower electrode 32 which extends beyond the upper electrode 30 due to the force of gravity. The exact positioning of the aperture 38 with respect to the lower electrode 32 will be a function of the angle of repose of the particulate matter being metered and of the height of the aperture 38 when the aperture is in the side of the chute, as shown. Accordingly, in a device which is intended to be used with more than one type of particulate matter, it is desirable to be able to vary the height of the aperture 38. One such means, best seen in FIGS. 4 and 6, comprises a screw 40 having a flanged head 42 which captures a turned edge 44 of the plate 46 which defines the upper edge of the aperture 38 and cam pegs 48 which ride in cam slots 50 in the plate 46. When the flanged head 41 is turned, it moves the plate 46 laterally, and the co-action of the cam pegs 48 and the cam slots 50 causes the plate 46 to move up or down, thereby causing the aperture 38 to widen or narrow.

As best seen in FIG. 5, the metering device further preferably comprises at least one wire 52 extending between the electrodes 30 and 32, spaced from both of them in the volume between them, but in electrical contact with the upper electrode 30. Still preferably, at least one of the wires 52 should extend between the electrodes 30 and 32 along a line which is vertically above the portion of the lower electrode 32 which extends beyond the upper electrode 30, as shown in FIG. 5.

The purpose of the wire 52 is to aid in the electrical dispersion and the mechanical breakup of aggregations of particulate matter, creating a small dust storm of dispersed particulates above and beneath each wire and speeding the conveying process within the metering device. The wire can be used in a number of operating modes. When it is used as a grounded electrode, it causes the electric field emitted from the charging electrode 32 to be concentrated at the wire. This provides for a stronger and more concentrated attracting force, causing an increase in the mechanical breakup of the particulates.

For powders with poor electrical properties, the wire 52 can be charged with the opposite polarity from the electrode 32. This produces a greater attracting force and adds more velocity to the particle. See Edward M. Purcell, 2 *Electricity & Magnetism* (1963), p. 9.

A third mode is to use the wire as a corona wire. This has been successfully used on dielectric powders for the purpose of charging by ion bombardment.

A further operating mode used for producing particulates with predominantly one polarity incorporates a number of wires 52 that extend beyond the electrode 32 and are centered between electrodes 32 and 30. The polarity of the wire or wires is opposite from the polarity of both electrode 30 and electrode 32, which have the same polarity in this mode. This electrode configuration produces particulates with a predominance of one polarity because the last contact by a particulate is usually electrodes 54 and 56. The final result of this arrangement is that the particulates are electrically attached to each other as they leave the metering devices because of their opposite polarity. This electrode arrangement is not usually used in conjunction with the electro/conveyor, but is used with the two electro/metering devices in close proximity and facing each other.

The output means 36 are clearly not central to this invention. However, when the metering device is used with an electro-static conveyor as shown in FIGS. 1–6, it can conveniently comprise a chute one wall 54 of which is integral with the upper electrode 30 and one wall 56 of which is integral with the lower electrode 32. The electrode 32 can additionally be made integral with the electrode 26, and the electrode 30 can be made integral with the electrode 24, but at a cost in increasing the complexity of the tilting means for the electro-static metering device (described hereinafter).

The metering device described above has proved a great success in obtaining a steady, accurately metered flow of very finely divided particulate matter at very low flow rates. As an example, using the device described above I have obtained a steady, uniform flow rate of 0.05 grams/minute for iron powder having an average diameter of 75 micrometers, something which, to the best of my knowledge, is not possible with conventional gravity operated, vibrator assisted metering devices.

Figure 1:
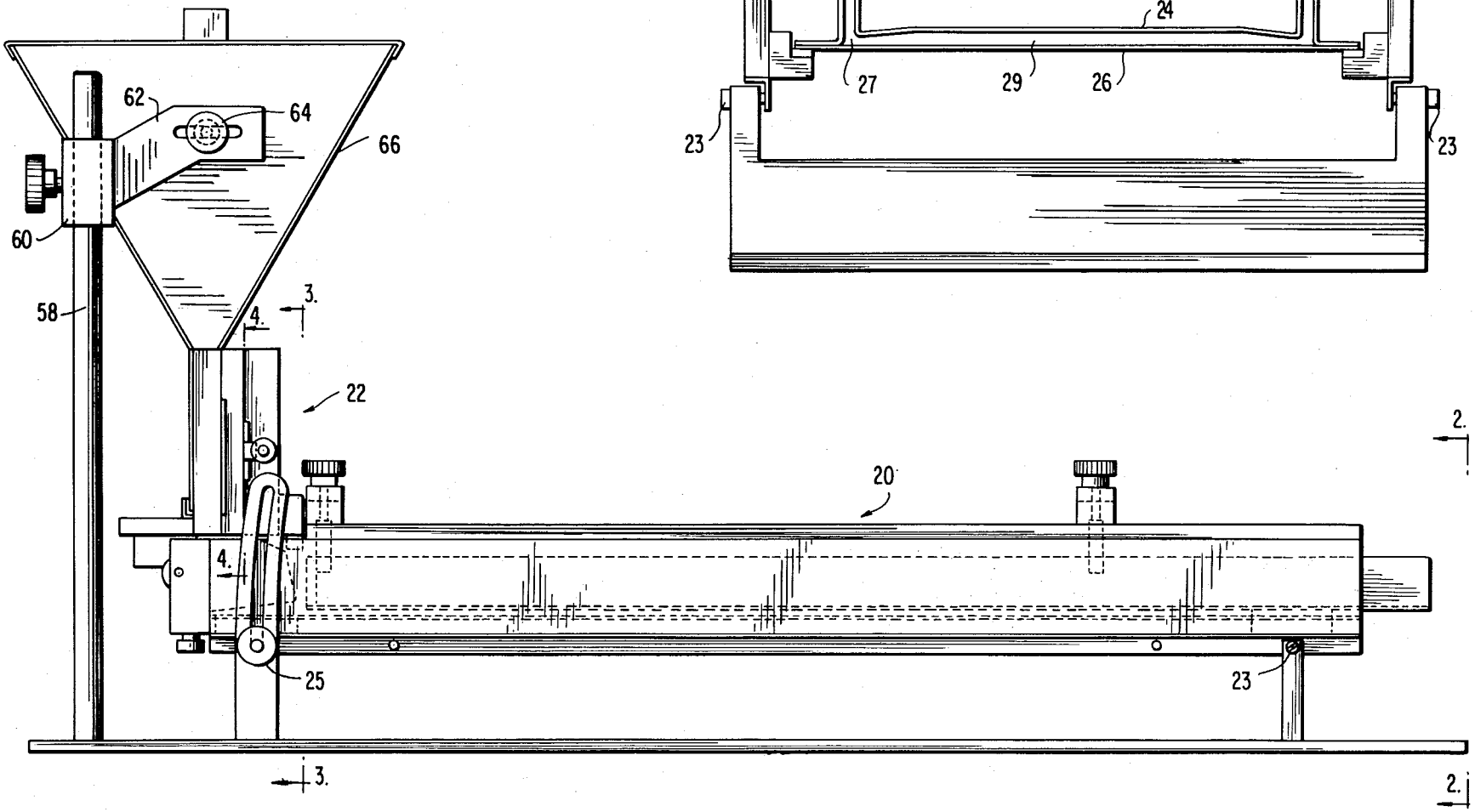
FIG. 1 shows an electro-static conveyor having a single electro-static metering device as an input.
Figure 4:
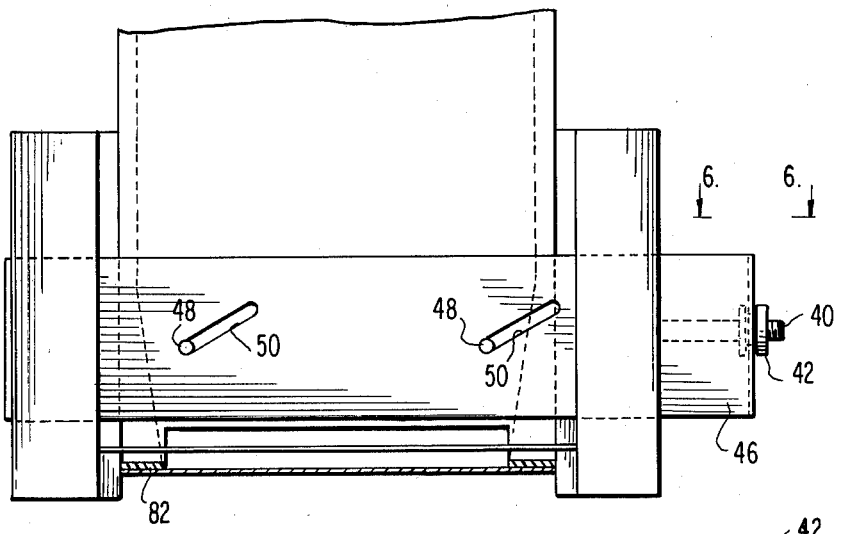
FIG. 4 is a view along the line 4—4 in FIG. 1.
Figure 6:
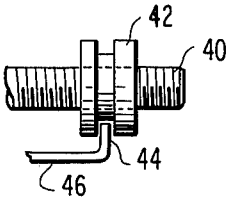
FIG. 6 is a view along the line 6—6 in FIG. 4.

When the metering device is used with an electrostatic conveyor as shown in FIGS. 1–6 which can be tilted at various angles as previously described, it is convenient to be able to vary the height and the longitudinal positioning of the metering device. One such means for varying the height of the metering device is shown in FIG. 1. It comprises a vertically positioned shaft 58 and a clamping collar 60 slidably mounted thereon. A means for varying the longitudinal positioning of the metering device is also shown in FIG. 1. It comprises a horizontally slotted mounting bracket 62 integrally connected to the clamping collar 60 and hold-down screws 64 threaded into the sides of the hopper 66. Alternatively, the metering device can be mounted on a pivot which permits limited swinging movement equivalent to the sum of the vertical and longitudinal movement accomplished by the illustrated apparatus.

Figure 3:
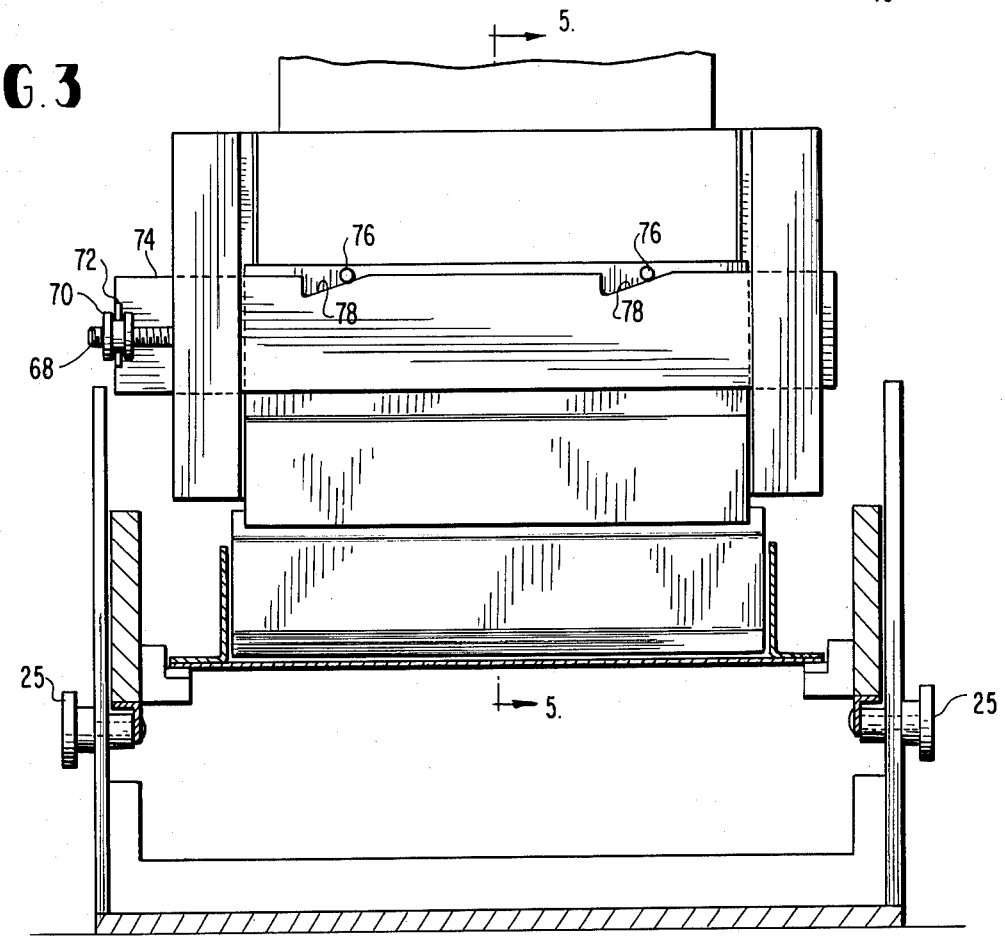
FIG. 3 is a view along the line 3—3 in FIG. 1.

The optimum spacing between the electrodes 30 and 32 is a function of the type of particulate matter being metered as well as of the difference in potential between the electrodes, and, for a metering device intended to be used with different types of particulate matter, it is desirable to be able to vary the spacing between the electrodes. One way of accomplishing this is shown in FIG. 3. As shown therein, it comprises a screw 68 having a flanged head 70 which captures a turned edge 72 of a plate 74 and cam pegs 76 integral with the upper electrode 30 which ride on cam surfaces 78 on the plate 74. When the screw 68 is turned, it moves the plate 74 laterally, and the co-action of the cam pegs 76 and the cam surfaces 78 cause the upper electrode 30 to move up or down.

Although the metering device as described up to this point works fine for most types of particulate matter, it has been found desirable with some particularly agglomerative materials to additionally provide a conventional vibrator opperatively connected to the input means 34. As illustrated in FIG. 5, a conventional vibrator 80 can be directly connected to the lower electrode 32 and indirectly connected to the means 34 via a resilient pad 82.

Figure 9:
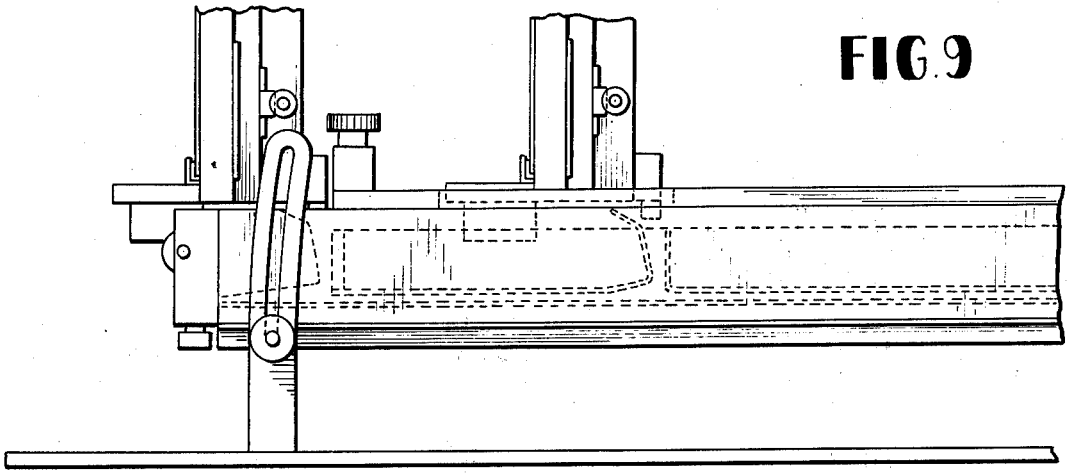
FIG. 9 shows a portion of an electro-static conveyor having two electro-static metering devices as inputs.
Figure 10:
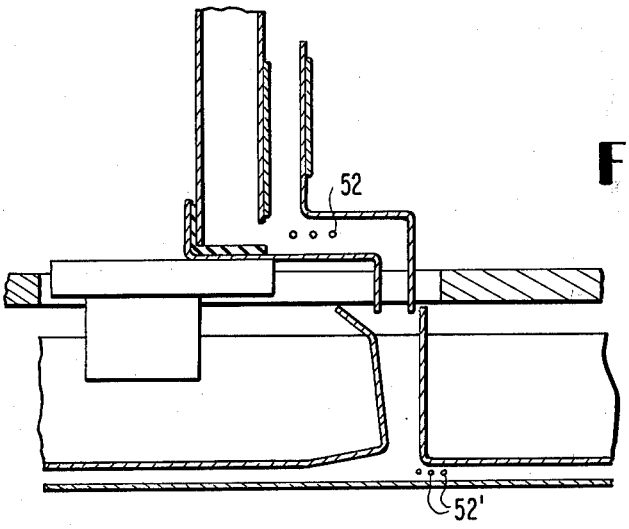
FIG. 10 is a sectional view showing a portion of the device shown in FIG. 9.

FIGS. 9 and 10 show a portion of an electro-static conveyor having two longitudinally spaced electro-static metering devices as inputs. Such a device functions as an electro-static mixer-blender for finely divided particulate matter, and it has been found useful to effect a complete mixing of particles of two different types which cannot be mixed successfully by conventional shaking or stirring apparatus. For instance, I have successfully mixed iron and copper with apparatus such as that shown in FIGS. 7 and 10, although a homogeneous mixture of those two materials cannot be obtained by conventional shaking or stirring techniques.

While not essential to the success of an electro-static mixer-blender such as is shown in FIGS. 9 and 10, particularly for relatively large input flows and/or for particulate matter which is relatively coarsely divided, it is of course preferable to use the previously disclosed metering devices as input means when those conditions do not obtain.

Figure 11:
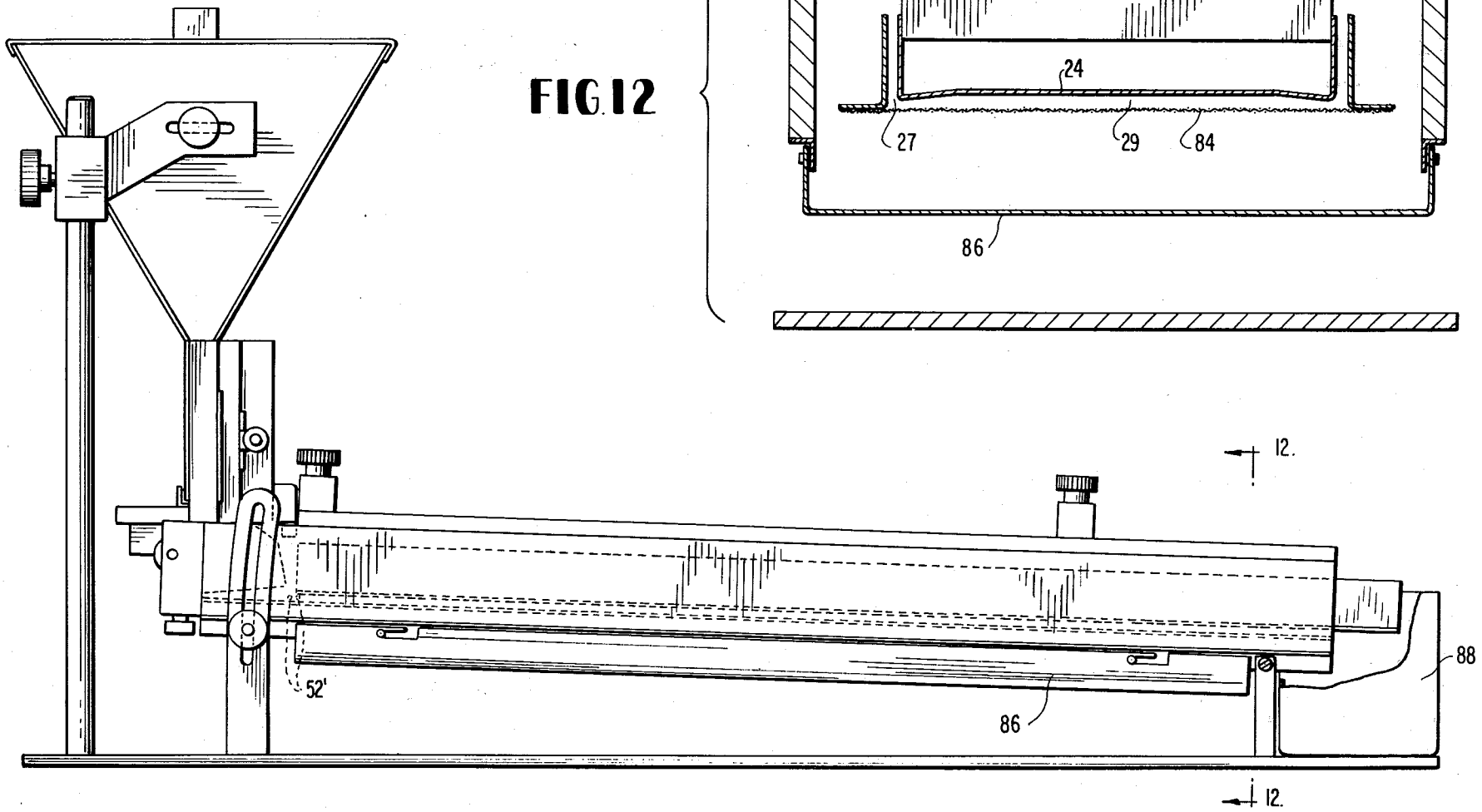
FIG. 11 shows an electro-static sieve having a single electro-static metering device as an input.

As previously mentioned, the converging electrode edge control technique and the control wire technique are just as applicable to electro-static sieves as they are to electro-static conveyors, and an electro-stativ sieve incorporating both techniques is shown in FIGS. 11 and 12. Most parts are the same as those in the electro-static conveyor shown in FIGS. 1–6, and their description will not repeated here. The only differences between the two devices are that the lower electrode 32 of the FIGS. 1–6 device is replaced by a sieve electrode 84 and that a collecting pan 86 for the fine particles is placed beneath the sieve electrode 84 and a collector pan 88 for the cource particles is placed at the end of the sieve electrode 84.

CAVEAT

While the present invention has been illustrated by detailed descriptions of the preferred embodiments thereof, it will be obvious to those skilled in the art that various changes in form and detail can be made therein without departing from the true scope of the invention. For that reason, the invention must be measured by the claims appended hereto and not by the foregoing preferred embodiment.

What is claimed is:

1. An electro-static metering device for finely divided particulate matter, said metering device comprising:

a. two spaced electrodes, one of which is vertically positioned above the other but offset therefrom so that the lower electrode extends beyond the upper electrode on one side of the metering device by a short distance and the upper electrode extends beyond the lower electrode on the opposite side of the metering device by a short distance;

b. means for placing finely divided particulate matter on the portion of said lower electrode which extends beyond said upper electrode; and c. output means positioned beneath the portion of said upper electrode which extends beyond said lower electrode.

2. An electro-static metering device as recited in claim 1 wherein said means for placing finely divided particulate matter on the portion of said lower electrode which extends beyond said upper electrode comprise a chute ending in an aperture positioned with respect to said lower electrode such that finely divided particulate matter in said chute will spill out onto the portion of said lower electrode which extends beyond said upper electrode due to the force of gravity.

3. An electro-static metering device as recited in claim 1 and further comprising at least one wire extending between said electrodes, spaced from both of said electrodes in the volume between them, but in electrical contact with said upper electrode.

4. An electro-static metering device as recited in claim 3 wherein said at least one wire extends between said electrodes along a line which is vertically above the portion of said lower electrode which extends beyond said upper electrode.

5. An electro-static metering device as recited in claim 1 wherein said output means is a chute one wall of which is integral with said upper electrode and one wall of which is integral with said lower electrode.

6. An electro-static metering device as recited in claim 1 and further comprising at least one wire extending between said electrodes and in electrical contact with neither the upper or lower electrodes, said at least one wire having the opposite electrical polarity from both the lower and upper electrodes.

* * * * *